US005899663A

United States Patent [19]

Feder et al.

[11] Patent Number: 5,899,663

[45] Date of Patent: May 4, 1999

[54] MODULAR CEILING FAN ASSEMBLY AND SYSTEM

[75] Inventors: Gary J. Feder, Germantown; Richard A. Pearce, Memphis; Masao Tsuji, Germantown; Jack W. Gee, II, Memphis; Scott P. Bojko, Germantown; Mark Hebert, Memphis, all of Tenn.

[73] Assignee: Hunter Fan Company, Memphis, Tenn.

[21] Appl. No.: 08/693,958

[22] Filed: Aug. 7, 1996

[51] Int. Cl.[6] ..... F04D 29/00

[52] U.S. Cl. ..... 416/5

[58] Field of Search ..... 416/5

[56] References Cited

U.S. PATENT DOCUMENTS

| | | | |
|---|---|---|---|
| 4,396,352 | 8/1983 | Pearce | 416/206 |
| 4,511,310 | 4/1985 | Pearce | 416/134 R |
| 4,513,994 | 4/1985 | Dover et al. | 248/544 |
| 4,592,702 | 6/1986 | Bogage | 416/5 |
| 4,692,096 | 9/1987 | Yang | 416/5 |
| 4,862,581 | 9/1989 | Royer | 29/596 |
| 4,884,947 | 12/1989 | Rezek | 416/5 |
| 5,151,011 | 9/1992 | Rezek . | |
| 5,154,579 | 10/1992 | Rezek | 416/5 |
| 5,222,864 | 6/1993 | Pearce | 416/5 |
| 5,302,083 | 4/1994 | Bucher et al. | 416/5 |
| 5,304,037 | 4/1994 | Scofield | 416/134 R |
| 5,441,387 | 8/1995 | Yu . | |
| 5,454,692 | 10/1995 | Davis | 416/5 |
| 5,458,464 | 10/1995 | Lee | 416/210 R |
| 5,462,412 | 10/1995 | Scofield et al. | 416/5 |
| 5,464,323 | 11/1995 | Scofield | 416/134 R |
| 5,486,094 | 1/1996 | Davis, Jr. et al. | 416/210 R |
| 5,489,191 | 2/1996 | Tai | 416/5 |
| 5,503,524 | 4/1996 | Yu . | |
| 5,507,619 | 4/1996 | Ryan | 416/5 |
| 5,624,230 | 4/1997 | Taylor et al. | 416/5 |
| 5,655,877 | 8/1997 | Yu | 416/5 |
| 5,658,129 | 8/1997 | Pearce | 416/5 |
| 5,681,147 | 10/1997 | Young-Chung | 416/5 |

*Primary Examiner*—John Kwon

*Attorney, Agent, or Firm*—Baker, Donelson, Bearman & Caldwell

[57] ABSTRACT

A modular ceiling fan assembly and system is disclosed in which the functioning components are standardized, including standardized connections for their assembly, and multiple components are provided with a plurality of alternate parts for assembly into a variety of uniquely differentiating configurations, styles and appearance without substantially increasing the cost to the manufacturer. The motor platform, including the motor, shafts, switch housing and electrical components and wiring, are standardized into a single configuration, and the holes for mounting the fan blades on the lower surface and/or upper surface of the rotor have a standardized size and spacing. A modular motor housing is formed from multiple horizontal sections, preferably two or three, with a standardized height to accommodate the common single motor platform. The various sections of the modular motor housing are selected in order to produce a variety of uniquely different appearances. Alternative modular blade attachments, including blade ring and paddle assemblies, blade ramps and blade irons, with and without blade rings, are configured to be mounted in the standardized mounting holes of the rotor. These components, together with the fan blades, have standardized hole spacing for interchangeable assembly of components into differentiating fan styles. As a result, top mounted fan styles, bottom mounted fan styles, and mid-body fan styles can be assembled from the modular components. Standardized packing cushion materials are also disclosed.

13 Claims, 12 Drawing Sheets

250
256
258
260
262
264
266
268

250
254
264
268

252
270
266
272

280
282
284
286

MODULAR CEILING FAN ASSEMBLY AND SYSTEM

FIELD OF THE INVENTION

The present invention relates to a modular ceiling fan system in which a plurality of compatible alternative parts are provided for each of a multiple of the components of the fan and which includes standardized connections among the functioning components to provide for arrangements of the components into a variety of similar fan assemblies having uniquely differentiating configurations, styles and appearances.

BACKGROUND OF THE INVENTION

The popularity of ceiling fans has increased tremendously in recent years. Today, consumers having a wide range of tastes and needs often purchase numerous ceiling fans for a single home or business to enhance the decor of the environment and to provide an extremely effective means to conserve the energy required to heat and cool the environment. As a result, the traditional ceiling fan market has evolved from a few basis models into a choice of hundreds of different fans. Further, due to their economic power, large retail chains often are in a position to require manufacturers to provide new designs for ceiling fans on an exclusive basis or as private label products in order to distinguish the configuration, style or appearance of their ceiling fans from the products offered by their competitors, even though the fans may be made by the same manufacturer. Thus, in response to evolving consumer tastes and demands and competitive pressures within the ceiling fan market, ceiling fan manufacturers are compelled to continuously create entirely new fan designs or lines of fan products in order to provided a variety of ceiling fans which are clearly distinguishable both from other fans in their own product lines and from ceiling fan products marketed by other competing manufacturers.

Whenever the design of a ceiling fan is changed, whether due to a change in consumer preferences or as an accommodation to a retail chain or other outlet, new parts and assembly drawings must be created, and different tooling must be produced for each of the new parts of the fan. The new parts then must be manufactured and inventoried. In addition, different packing materials must be developed and produced for each new fan design, including different size packing cartons, different cushion material customized to fit the cartons and the parts, different ornamentation for the cartons, and different arrangement of cartons for shipment on a pallet. The production of many different lines of ceiling fan products also substantially increases the cost of raw materials, labor, material, handling and inventory for a manufacturer. Further, it often is necessary to provide a separate packing line to package the final product after it comes off of the assembly line. Moreover, typically a production line must be completely shut down in order to incorporate adjustments for a new ceiling fan design.

The few prior efforts to produce a ceiling fan having interchangeable components typically utilize a limited number of parts for only one of the components of the ceiling fan. However, these efforts to not significantly reduce manufacturing costs or allow the production of a large variety of uniquely different fan configurations, styles or appearances.

For example, U.S. Pat. No. 5,151,011 discloses only non-modular interchangeable matched top and bottom globe-like covers for a lighted ceiling fan in which each cover is manufactured as a complete unit. U.S. Pat. Nos. 5,441,387 and 5,503,524 disclose ceiling fan motor housings configured to receive different inserts which alter only the decorative pattern on the housing. Clearly, none of these prior efforts provide a system in which a wide variety of ceiling fans having uniquely differentiating styles, configurations, and appearances can be produced from a single standardized ceiling fan assembly, while substantially reducing the cost to the manufacturer.

SUMMARY OF THE INVENTION

In accordance with the present invention, a modular ceiling fan assembly and system is provided in which a multiplicity of the components of the basic fan structure have a plurality of alternative configurations or assembly arrangements so as to produce assembled fans that have markedly different configurations, styles or appearances. It has been discovered that such a modular ceiling fan assembly and system can be achieved by standardizing the functioning components of the fan assembly and providing common standardized connecting structure and generally standardized sizing for the different alternative parts for each component. Hence, with the modular system of the present invention, each of the components of a ceiling fan is selected from among a variety of alternatives which can easily be assembled into a uniquely differentiating fan configuration, regardless of which alternative part is selected, without any signification changes or adjustments in the manufacturing process.

Typically, the basic components of a ceiling fan include a hanging bracket, a canopy, a down rod or hanging rod, a pivot ball, a motor, a motor housing, a switch housing, a switch housing cover, fan blades, and blade attachment structure, with or without blade medallions or covers, together with customary switches and electric components. In accordance with modular system of the present invention, many of these basic components may be designed in a variety of shapes, structures, or forms. However, since each of the variations has standardized sizing and connecting structure, the components of the fan can be connected in a multitude of different combinations and positions within the overall assembly to provide ceiling fans which are perceived as having markedly different configurations, shapes or appearances. Providing different modular components for the motor housing is a particularly effective way to change the overall configuration, shape, or appearance of the ceiling fan and provide a maximum perceived differentiation in the eyes of the retailer and consumer. Accordingly, the modular system for providing alternate components for the motor housing is a significant feature of the system of the present invention.

In accordance with the present system, the motor housing is formed from multiple, preferably two or three, horizontal sections which are vertically connected. Each of the sections of the motor housing can then be varied by providing different vent hold patterns, different exterior configurations within predetermined size limits, and different surface ornamentation, such as the positioning and style of the annular ring decoration. However, the portions of the motor housing sections which are secured together and the portions of the motor housing which interact with the other components of the ceiling fan assembly are provided with standardized connecting structure and the motor housing sections are selected to conform to a standard height dimension, so that the motor housing sections can be combined to form a housing component which operably connects with the other components of the fan assembly.

Another component of the ceiling fan in which changes contribute to a maximum perceived differentiation in the overall design of the fan in the eyes of the retailer and consumer is the attachment structure for securing the fan blades to the motor. In a preferred embodiment of this feature, the fan blades are attached to the lower surface of the motor. In alternate embodiments, the fan blades can be attached to the upper surface of the motor, or supported from the upper surface of the motor in a manner which creates the appearance that the blades are attached to the middle of the motor. In a preferred embodiment, an integral blade ring and paddle assembly is provided with standardized hole spacing which corresponds to the hole spacing provided in the motor casing for attaching the blade ring to the lower surface of the motor casing. Blade ramps or blade irons can be substituted for the blade ring in order to further change the overall appearance of the ceiling fan. Each of these modular blade attachment components is provided with standardized hole spacing for the attaching screws which corresponds to the spacing of the holes in the lower surface of the motor. Alternatively, the top surface of the motor may be provided with holes, which are preferably standardized to correspond to the hole size and spacing on the bottom surface, so that the blade ramps or blade irons may be mounted on the top surface of the motor. The spacing between the holes and the dimension of the holes on the top and/or bottom surfaces of the motor, in the blade ring, blade ramps or blade irons and in the fan blades are standardized so that the fan blades can be secured to the bottom of the motor for a bottom mounted fan or the fan blades may be secured to the top of the motor for a top mounted fan or a mid-body fan.

Other ceiling fan components for which alternative modular designs may be provided include the canopy, the down rod, the fan blades, the switch housing, the switch housing cover, and the blade ring cover, the blade irons, and/or the blade medallions. However, in accordance with the modular system of the present invention, each of the plurality of alternatives has standardized sizing, at least in the height dimension for certain components, and standardized connecting structure throughout the modular system for easy substitution of alternative parts which are compatible with the other components.

It is understood that the cooperation of the alternative components within the overall assembly is possible due to a common standardization of sizing and connecting structure among the various functioning components. Secondary components of the fan assembly which fit together with the other primary components, can be incorporated in the modular assembly. For example, the wire/circuit connections, the pull chain switches, the capacitors, the fan speed and reverse switches, the light kits and the remote control circuitry, to name a few, may also include standardized connections to provide for a plurality of alternative choices.

By standardizing the height dimension, preferably for each component, and maintaining the other geometry for each component within a limited range, standardization of the packing carton and cushioning foam or material can also be achieved. Further, standardization allows the manufacturer to use a common printing layout for the packaging, such as the use of small adhesive labels. The packaging material can include standardized sizing for the cutouts which receive components manufactured within the size limitation ranges. By using standardized alternative components in a modular ceiling fan assembly and system, it is apparent that dramatic savings in design, printing, tooling and packaging expenses can be achieved. The present system allows a manufacturer to preassemble many of the components of the fan, such as the entire motor platform or the motor housing. These preassembled components then can be feed into the production line for the entire modular fan assembly. The modular system of the present invention also streamlines the final assembly process by allowing the packaging line to become part of the production line. Thus, the present modular system substantially increases the range of possibilities for different designs and appearances for ceiling fans while providing significant reductions in the costs to the manufacturer.

Accordingly, it is one object of the present invention to provide a modular ceiling fan structure and system in which a multiplicity of fan components having a plurality of alternative parts can be interchanged to produce similar ceiling fan assemblies with marked differences in configuration, style or appearance.

It is another object of the present invention to provide a modular ceiling fan system which allows manufacturers to select from among alternative parts and assembly arrangements for a multitude of fan components to produce a fan assembly for the retailer's exclusive sale or market which is unique and easily differentiated from other ceiling fans being marketed.

Yet another object of the present invention is to provide a modular ceiling fan system in which each of a plurality of alternative parts or arrangements for each component is provided with common standardized connecting structure so that the parts can be easily connected to assemble a fan having a selected design.

Still another object of the present invention is to provide a modular ceiling fan assembly in which many of the basic components which contribute to the overall configuration, style and appearance of the fan, including the canopy, down rod, motor housing, switch housing, switch housing cover, fan blades, and blade attachment structure, can each be selected from a multitude of difference components which have standardized connecting structure to create or design a ceiling fan which has a markedly distinctive configuration, style and appearance, without the need to reengineer and/or retool individual components for the fan.

A still further object of the present invention is to allow the use of standardized packing cartons, cushioning material, and/or printing layouts providing each of the components in a modular ceiling fan system with standardized sizing within predetermined size limits so that the components conveniently fit within standard size cartons and cushioning material.

A final object of the present invention is to provide a modular ceiling fan assembly in which each component of the fan has a standardized height dimension and connecting structure and has been selected from a plurality of different compatible parts or assemblies which are provided for each component in the selected fan assembly.

These and other objects, features, and advantages of the present invention will become better understood when referring to the following description, appended claims, accompanying drawings wherein like numerals refer to like parts throughout.

DETAILED DESCRIPTION OF THE PREFERRED EMBODIMENTS

Figure 1:
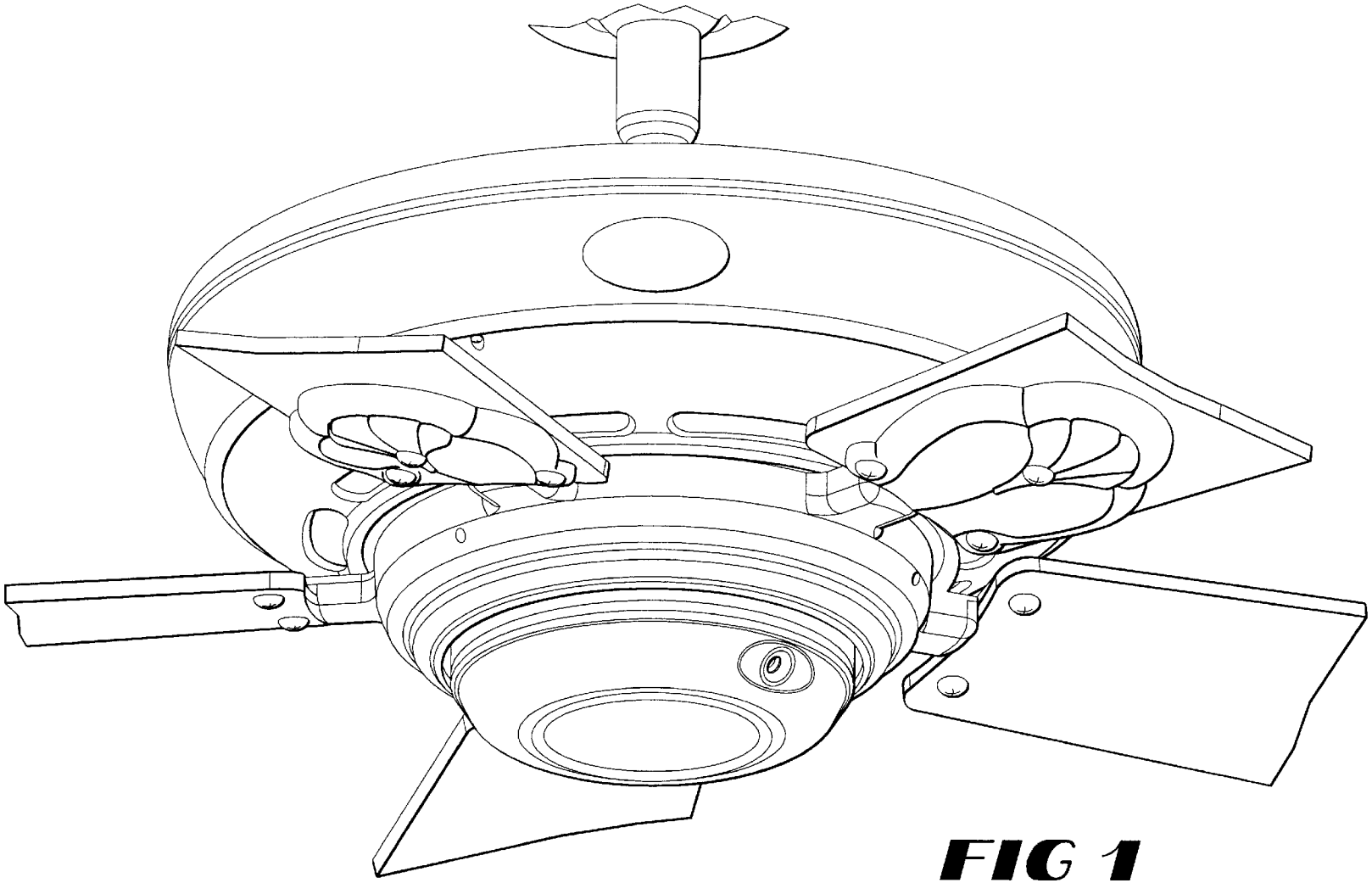
FIG. 1 is a perspective view of a modular ceiling fan assembly according to the principles of the present invention.

In describing the preferred embodiments of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

With reference to FIG. 1 of the drawings, one preferred arrangement of a modular ceiling fan embodying the teachings of the present invention is generally designated by the numeral 20. According to the principles of the present invention, most of the components of the fan which contribute to the style, design and overall outward appearance of the fan my be selected from a plurality of compatible alternative parts or configurations. Any substitution of one component part for another alternative component part will not affect the ability to assemble the modular ceiling fan since the critical height dimensions and connecting structure for each interchangeable component is standardized throughout the fan structure.

Figure 2:
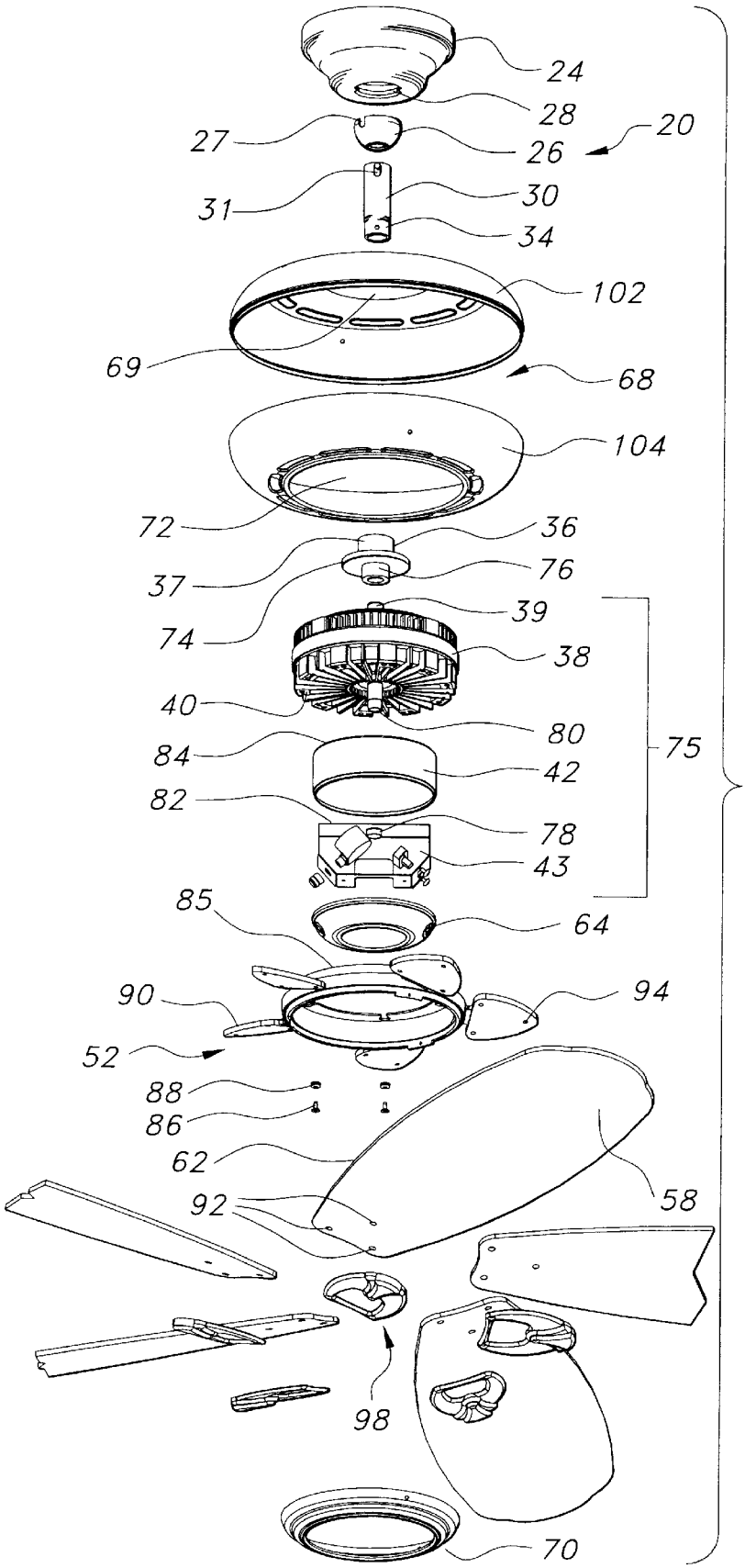
FIG. 2 is a perspective exploded view illustrating the various components of the assembled fan shown in FIG. 1.
Figure 3:
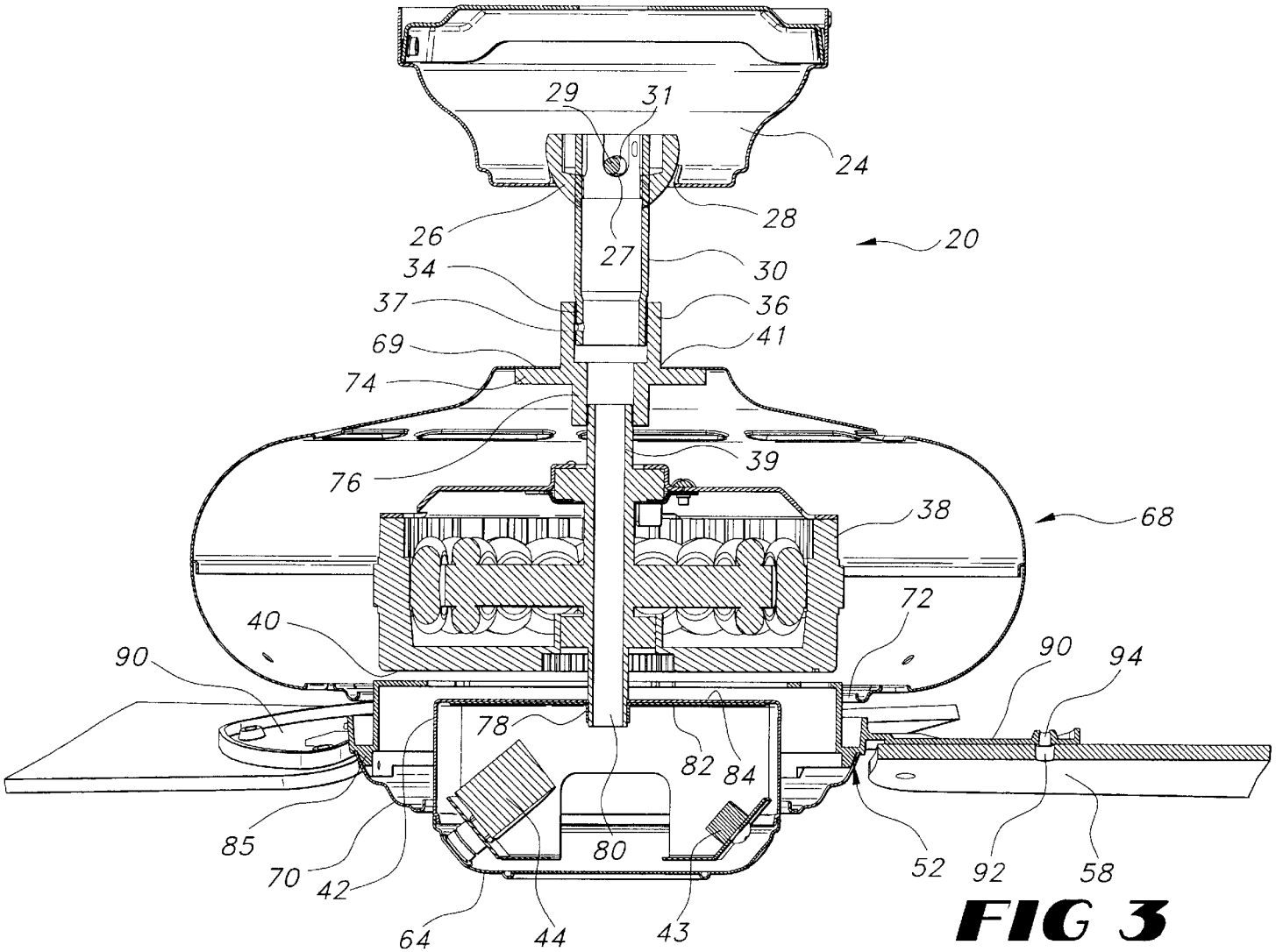
FIG. 3 is a cross-section view of the fan taken along line 3—3 of FIG. 1.

In this preferred arrangement, the ceiling fan includes a canopy 24, a down rod 30, a modular motor housing 68, and blades 58 attached to the lower surface 40 of the motor 38 (see FIGS. 2 and 3). The modular motor housing 68 is supported on an adaptor 36 connected to the lower end of the down rod 30. The motor 38 is then inserted into the modular housing 68 through opening 72 in the bottom of housing 68, and the upper end of the stator shaft 39 of the motor is supported on the lower end of the adaptor 36. The blades 58 are attached to the lower surface of the rotor within motor 38 through an integral blade ring and paddle assembly 52. Blade ring cover 70 covers the circular ring attachment structure of the blade ring and paddle assembly 52, which might otherwise be seen from below through opening 72 in the modular housing 68. Likewise, switch cover 64 is placed over the opening in switch housing 42 to conceal the switching mechanisms.

Turning now more specifically to the details of the components assembled in accordance with the principles of the present invention as shown in FIGS. 2 and 3, a mounting bracket 22 is shown which is to be anchored to an electrical box (not shown) secured in a ceiling. Secured to the mounting bracket 22 is a canopy 24 having a pivot ball 26 mounted within a central opening 28 in a conventional manner. Extending down through the center of pivot ball 26 and the opening 28 is a generally cylindrical down rod or hanging rod 30. The down rod 30 is supported at its top in the pivot ball 26 by a pin 29 which extends through hole 31 and projects outwardly on both sides to be supported in recesses 27 on each side of ball 26, all in a known and conventional manner.

In accordance with the modular system of the present invention, the canopy 24 can be a modular component of the ceiling and substituted with any other canopy which has standardized dimensions for the opening 28 receive a standardized pivot ball 26 and standardized dimensions for the upper perimeter which is mounted on a standard mounting bracket 22. Similarly, the configuration of the upper end of the down rod 30 and the pivot ball 26 are standardized so that, whichever alternative down rod is chosen, will properly fit within and be secured to the pivot ball 26. The lower end 34 of down rod 30 is also configured in this modular embodiment with standardized external threads which mate with the standardized internal threads provided within the top of the adaptor 36. By providing a standardized attachment structure in the down rod 30, the length, shape and style of the down rod 30 can be altered by selecting any interchangeable down rod having the requisite standardized upper and lower ends.

Before threading adaptor 36 onto the lower end 34 of down rod 30, the adaptor is inserted through the opening 72 in the bottom of the modular motor housing 68 so that the upper end 37 of the adaptor projects through opening 41 in the top surface 69 of the modular motor housing and the top surface 69 engages and rests on flange 74 of adaptor 36. Thus, when the adaptor 36 is threaded onto the lower end 34 of down rod 30, the modular motor housing 68 is supported by engagement of the top surface 69 with flange 74. Once the adaptor 36, with the modular motor housing 68 supported thereon by flange 74, is assembled with down rod 30, motor 38 is inserted through the opening 72 of the modular motor housing and the stator shaft 39 is threaded into the lower end 76 of adaptor 36.

Switch housing 42 and switch bracket 43 are secured adjacent the bottom surface 40 of motor 38 by threading collar 78 of switch bracket 43 onto the lower end 80 of the stator rod shaft of motor 38. Threaded collar 78 is formed as part of the switch bracket 43 and its upper surface 82 supports the upper surface 84 of switch housing 42 adjacent the bottom surface 40 of motor 38 as collar 78 is threaded onto the lower end 80 of the stator shaft.

Preferably, the upper surface 82 of switch bracket 43 is attached to the upper surface 84 of the switch housing 42 as by welding or the like, and the electrical components and wiring are preassembled to form a single unit. Also, collar 78 is preferably preattached to the lower end 80 of the motor shaft to form the motor platform, generally designated by the number 75. In accordance with the present invention, the motor platform 75, the switch housing 42, the switch bracket 43, and the electrical switches and wiring are preferably a single configuration for all varieties of the modular fan assembly. Thus, the assembled motor platform 75 is preferably inserted through opening 72 to mount stator shaft 39 into the lower end 76 of adaptor 36.

The electrical components of switch housing 42 and their mounting on the switch bracket 43 are conventional, but may be altered from that shown so that different motor functions can occur, such as, for example, substituting the manual pull chain 46 for speed control switch 44, and the button (not shown) for direction control switch 43, with a remote control operation of these switches for the motor.

As shown on the bottom surface 40 of the motor 38 in this embodiment (see FIG. 2), the blade mounting holes are in pairs or sets 48. In this preferred form of the invention, five pairs or sets of blade mounting holes are provided in the bottom surface 40 of the motor 38. A constant standardized spacing is provided between the holes in each pair 48 and an equal standardized spacing is provided between each adjacent pair of holes. Further, each of the holes has a predetermined standard diameter.

In the preferred form of the invention as disclosed in FIGS. 1–3, the integral blade mounting ring and paddle assembly 52 is mounted on the bottom surface 40 of the motor 38 by a series of five screws 86 and grommets 88 in a manner similar to that disclosed in U.S. Pat. No. 4,511,310. The grommets 88 are equally spaced in relatively thin, recessed sections of the ring having holes which correspond with one hole of each of the five pairs or sets 48 on the bottom surface 40 of the motor. Any similar standardized blade mounting ring and paddle assembly can thus be readily installed on the bottom surface 40 of the motor 38. The ring and paddle assembly 52 includes paddles 90 which extend radially outwardly from the inner mounting ring 85. The assembly 52 is provided with the requisite number of paddles 90 to mount the desired number of blades 58. As illustrated in FIG. 1, the assembly 52 preferably has five paddles 90 for mounting the proximate ends 62 of fan blades 58. One advantage of the blade ring and paddle assembly 52 is that alternate blade ring assemblies, having a different number of paddles can be readily substituted to create fans having a different number of fan blades, as long as the blade ring is provided with standardized mounting holes.

Holes 92, having a standardized diameter and spacing, are drilled through the proximate end 62 of blades 58 and mate with the standardized holes 94 in paddles 90 to receive screws 96. As shown in FIGS. 1 and 2, the blade medallions or covers 98 may be provided to cover the proximate end 62 of blades 58 and include similar standardized holes 100 which mate with holes 92 and 94. Thus, when assembled, screws 96 pass through holes 100 in medallions 98 and then through holes 92 in the proximate end of blades 58 to be threadedly screwed into holes 94 in paddles 90. While medallions 98 are preferred, they are not required. Alternatively, the medallions may be cast with appropriate bosses or raised portions for forming internally threaded bores to receive screws inserted from the top of the blade through paddles 90 and holes 92 to engage the threaded bores in the medallions 98. In this manner, the heads of mounting screws 96 cannot be seen from below, permitting the medallions to have a cleaner surface appearance.

Cooperating with the switch housing 42 is switch housing cover 64 including holes 66, 68. The holes 66, 68 cooperate with the positioning of button switches and/or chains extending from the switch housing 42. According to the principles of the present invention, even if the appearance of the switch housing cover configuration is altered, the switch housing cover would still be positionable on the switch housing by a standardized connecting structure.

Figures 4A, 4B, 4C:
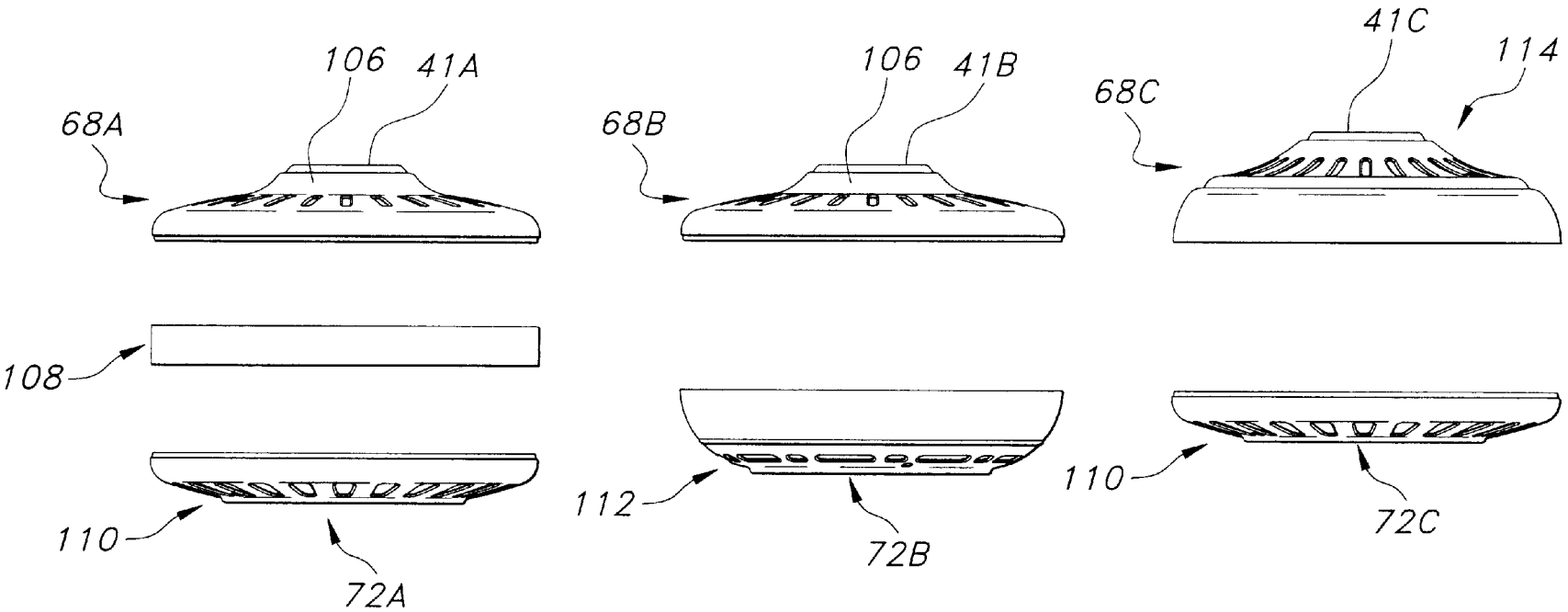
FIGS. 4A, 4B and 4C illustrate alternative modular motor housings for substitution in the modular fan assembly shown in FIG. 1.

FIGS. 4A, 4B and 4C illustrate alternative modular motor housings 68A, 68B and 68C, respectively, which can be readily substituted for modular motor housing 68 of FIGS. 1–3 in accordance with the present invention. In order to achieve the interchangeability of alternate modular motor housings 68, 68A, 68B and 68C in the modular ceiling fan assembly of the present invention, the openings 72, 72A, 72B and 72C in the bottom surface of the housings and the openings 41, 41A, 41B and 41C in the upper surface of the housings are all standardized to connect with and receive the various other components of the ceiling fan assembly. In addition, the height dimension for each of the modular motor housings 68, 68A, 68B and 68C is standardized to a selected manufacturing specification. The standardized height and opening dimensions are selected to ensure that each interchangeable modular motor housing can accommodate the selected configuration for the single common motor platform, such as platform 75. Standardization of the motor platform 75 into a single design and configuration greatly simplifies the manufacturing, assembly, inventory and shipping of the motor platform components. On the other hand, in accordance with the present invention, the parts which are combined to form the modular motor housing can be greatly varied to provide a markedly different configuration, style or appearance.

For example, a preferred standardized height for a modular motor housing in accordance with the present invention is approximately 4.75 inches. Modular motor housing 68, as shown in FIGS. 1–3, is made up of two parts, a top section 102 and a bottom section 104, each of which has approximately the same height of 2.37 inches. In contrast to the configuration, style and appearance of modular motor housing 68, alternative modular motor housing 68A is made up from three components, a top section 106, a center band 108 and a bottom section 110. In order to meet the standardized height of about 4.75 inches, the height of the center band for housing 68A is about 1.2 inches, with a short top section 106 and short bottom section 110, each about 1.87 inches high.

The short top section 106 and short bottom section 110 can then be combined with a tall bottom section 112 (FIG. 4B), or tall top section 114 (FIG. 4C), respectively, without utilization of a center band to produce, again, alternate modular motor housings 69B and 69C. The alternate modular motor housings 69B and 69C have markedly different configurations, styles and appearances from either housing 68 or housing 68A, which are also uniquely differentiating from each other. In the preferred embodiments of the present invention, the height of the tall upper section and tall lower section is about 3.37 inches each so that, when combined with the short lower section 110 or short upper section 106, respectively, the modular housings 68B and 68C have the requisite standardized height of approximately 4.75 inches.

Figures 7A, 7B, 7C, 7D, 7E, 7F, 7G, 7H:
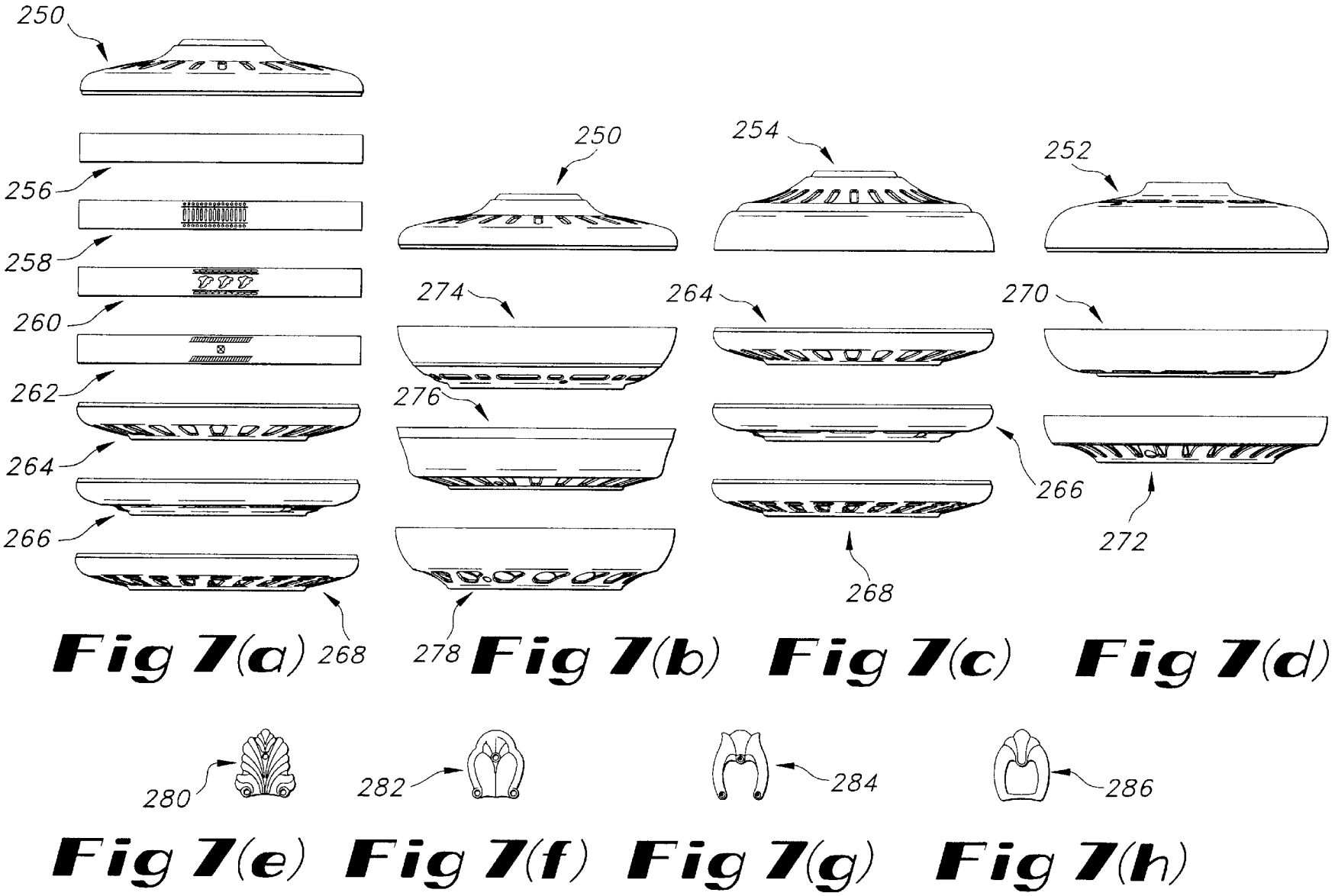
FIGS. 7(*a*)–(*h*) illustrate the interchangeable components of a modular system for a ceiling fan motor housing and blade medallions according to the principles of the present invention.
Figure 8:
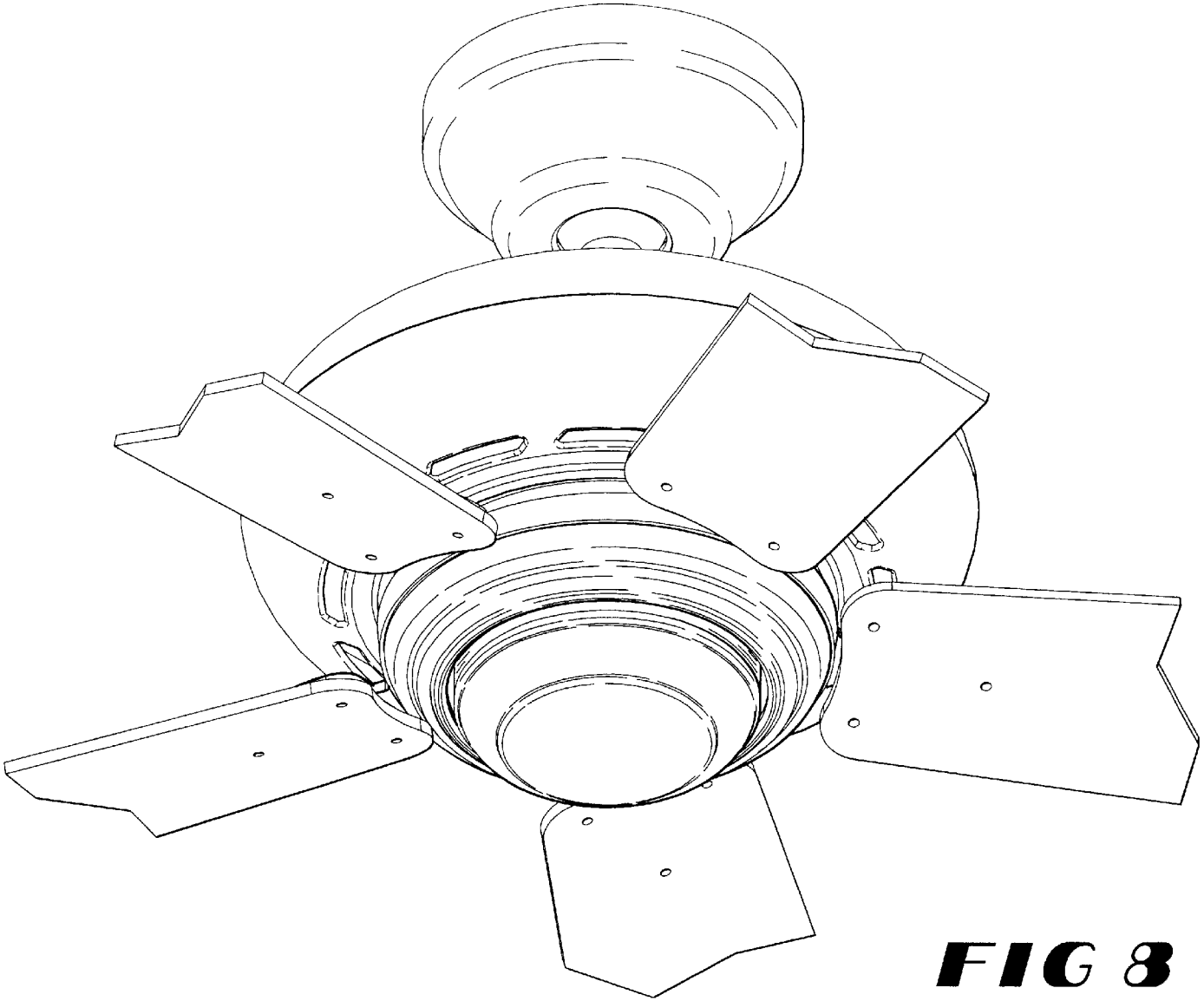
FIGS. 8, 9, and 10 illustrate three different ceiling fan designs created from combinations of the modular components shown in FIG. 7.
Figure 9:
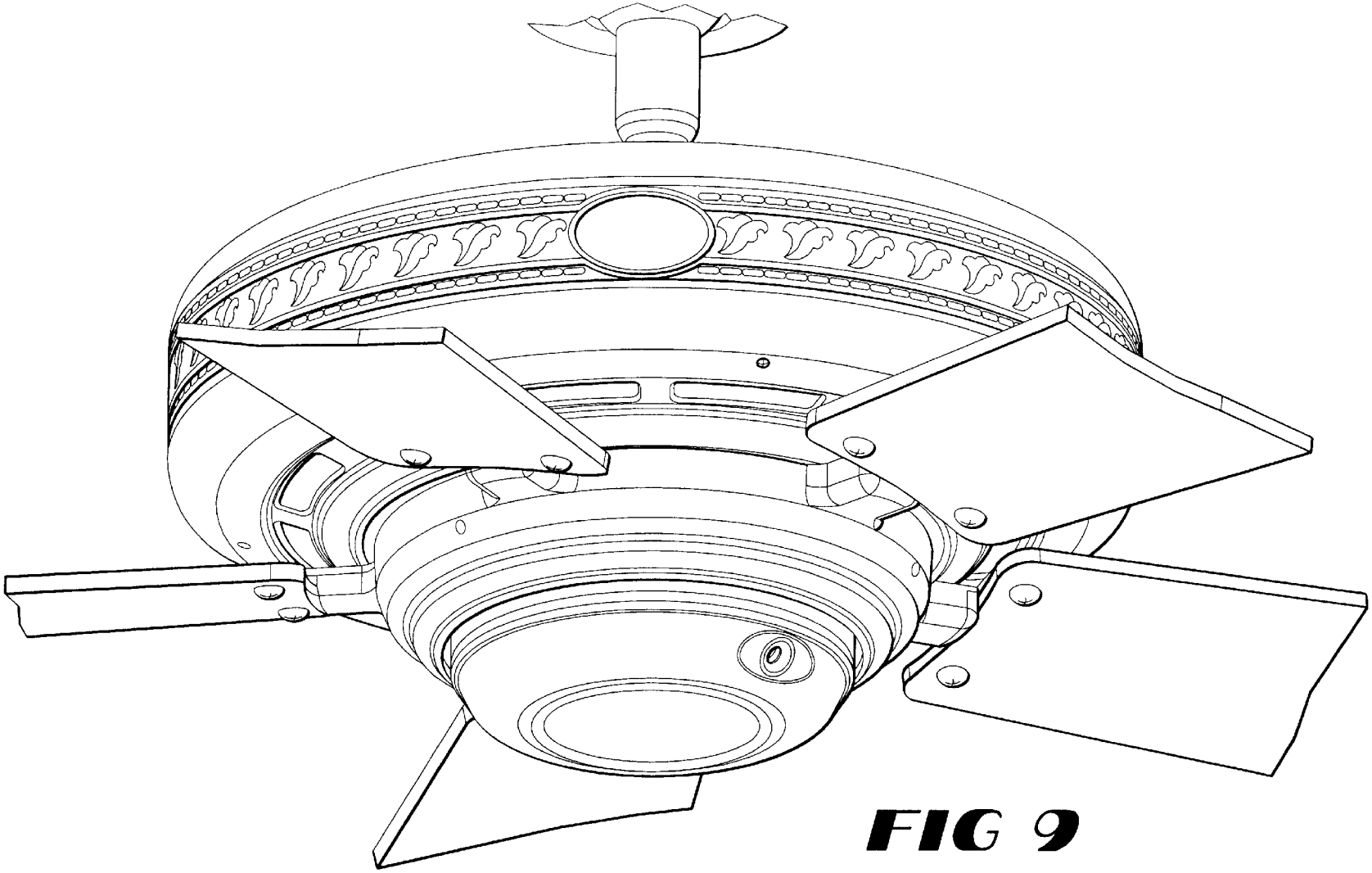
Figure 10:
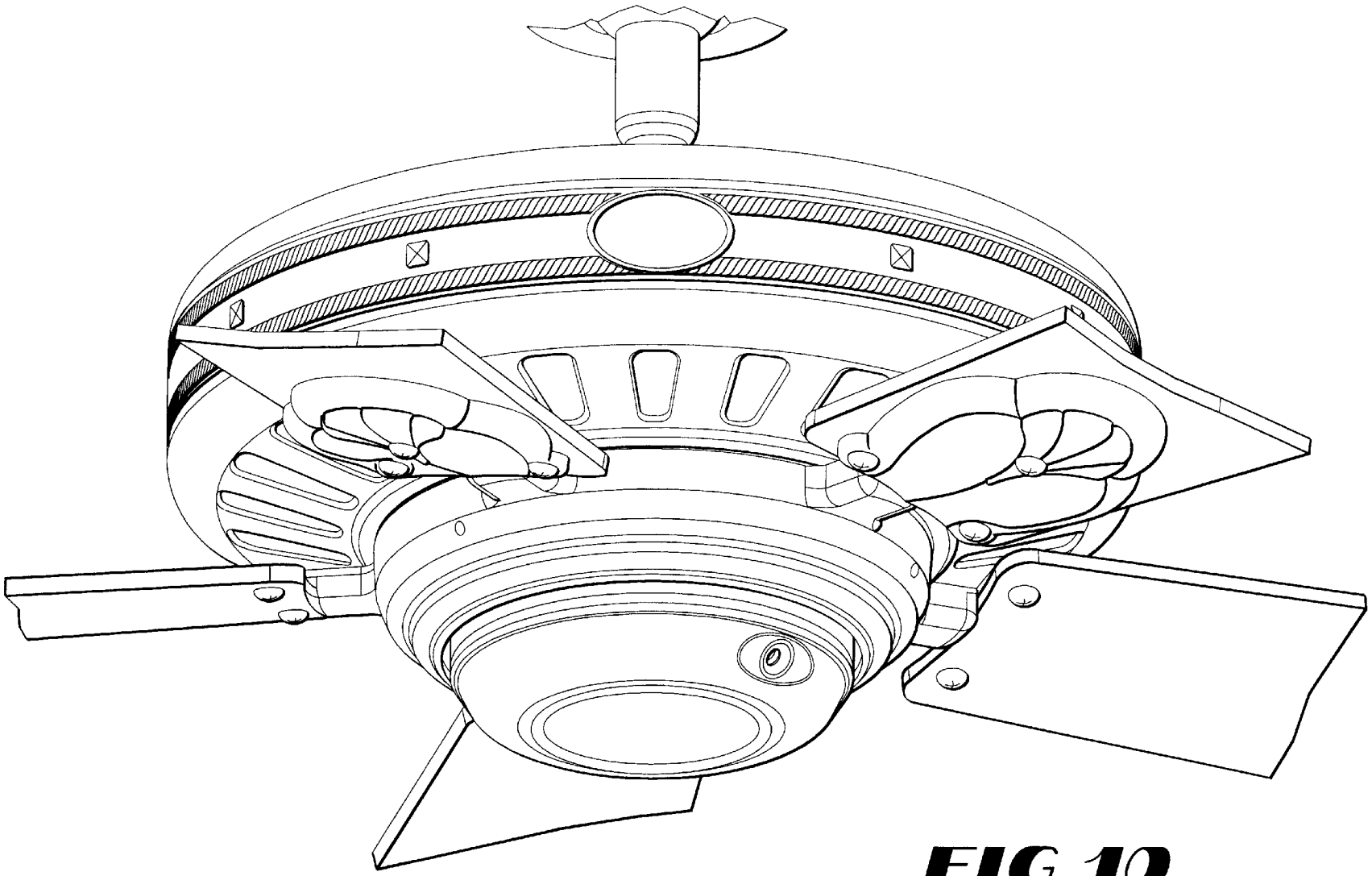

The parts of each modular motor housing 68, 68A, 68B and 68C can be assembled and secured together in any suitable fashion. For example, the facing edges can have appropriate overlapping fitting edges, and bolts with appropriate nuts can extend between and hold the upper and lower sections together, with or without a center band, all in a conventional manner. In addition, each of the upper sections 102, 106 and 114, and each of the lower sections 104, 110 and 112, can be configured to have varying venting designs and the center band 108 can be configured to provide different annular ring decorations. Thus, as shown in FIG. 7, a typical modular motor housing system in accordance with the present invention, may include only three different upper sections, short upper section 250, a medium upper section 252 and a tall upper section 254, four center band configurations 256, and eight different sections, including three short lower sections 264, 266 and 268, two medium lower sections 270 and 272, and three tall lower sections 274, 276 and 278. However, as many as eighteen different modular motor housings can be produced from the motor housing components shown in FIG. 7, each modular motor housing being differentiatingly unique in configuration, style and appearance. Additional variations in the outward appearance of the overall design of the fan can be achieved by varying the medallions 280, 282, 284 and 286, which are attached to the surface of the fan blades. FIGS. 8, 9, and 10 illustrate three markedly different ceiling fan designs which were created from combinations of the modular motor housing components shown in FIG. 7. Furthermore, by varying the color and/or decorative patterns on the upper and lower sections and center bands, even more pronounced variations in the appearance of the design can be generated without creating additional design configurations, changing tooling, reconfiguring packing materials, or making other costly adjustments in the manufacturing process.

Figure 5A:
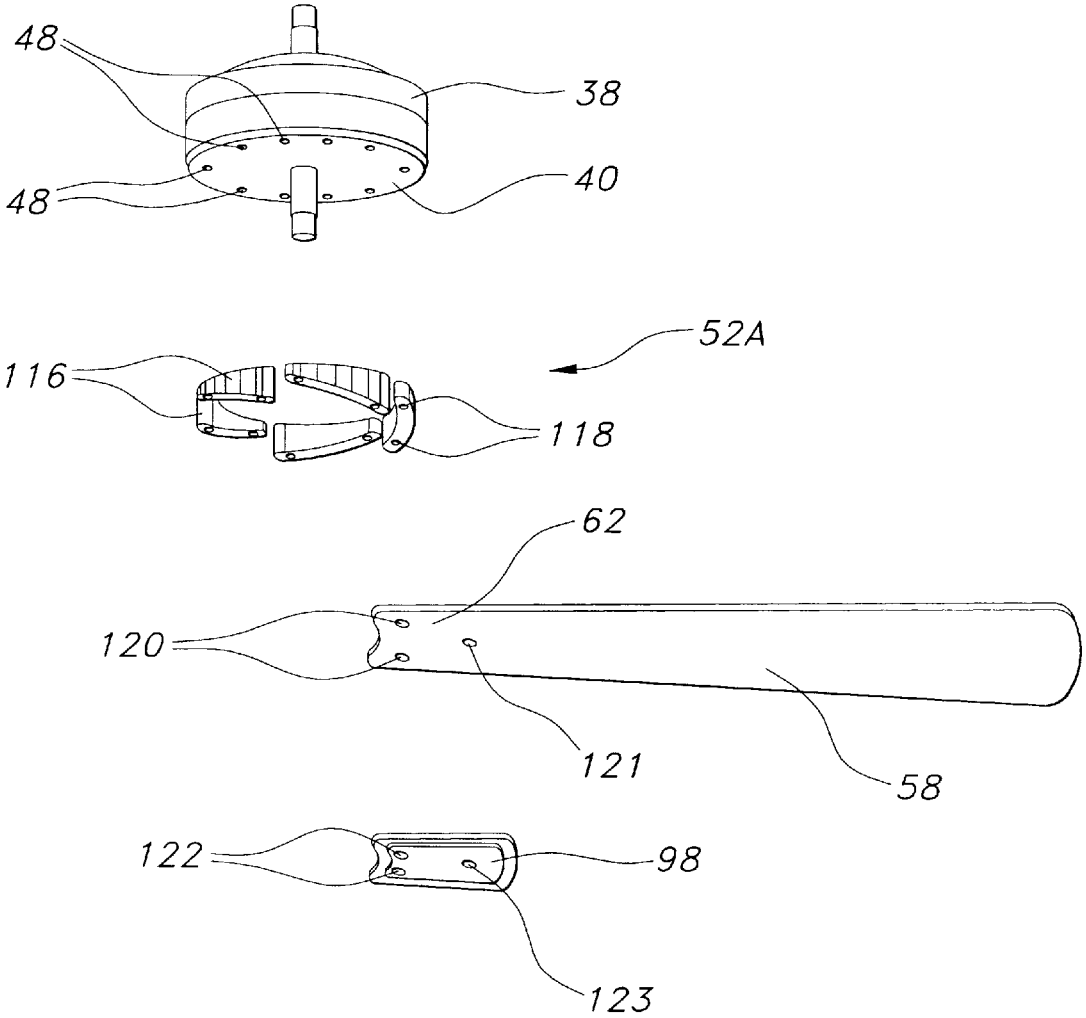
FIGS. 5A and 5B illustrate alternative modular fan blade attachments for substitution in the modular fan assembly shown in FIG. 1.
Figure 5B:
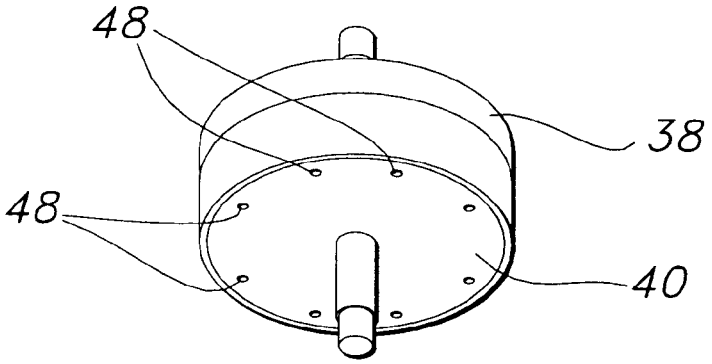
Figure 5B:
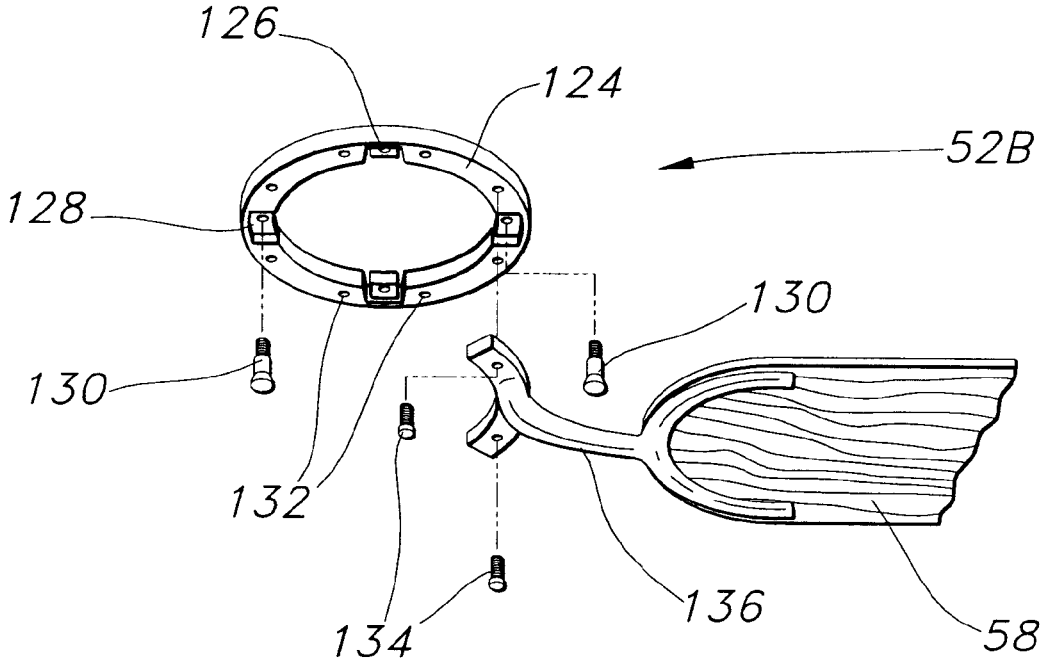

Turning now to FIGS. 5A and 5B, different modular blade attachments are shown for mounting the fan blades to the rotor portion of the motor, generally designated by the numeral 52A in FIG. 5A, and the numeral 52B in FIG. 5B. In the FIG. 5A configuration, standardized blade ramps 116 are utilized to attach blades 58 to the lower surface 40 of the rotor portion of motor 38. Each standardized blade ramp 116 has the same standard spacing between standardized vertical holes 118 as each set of holes 48 in the bottom surface 40. Holes 120 in the proximate end 62 of blades 58, and holes 122 in medallion or cover 98, have similar standardized diameters and spacing. Thus, screws (not shown) passing through holes 122, then holes 120 and 118, and finally threaded into holes 48 anchor and secure the blade medallions 98 and fan blades 58 to the blade ramps 52 and the bottom 40 of the motor. The hole 121 in the proximate end 62 of blade 58, and the hole 123 in the blade medallion 98, have standardized spacing and are configured to attach the outer end of the medallion 98 to the blade 58 by any suitable attachment, such as screws, bolts and nuts, or the like.

With respect to the modular blade attachment 52B shown in FIG. 5B, attachment ring 124 has recesses and openings 126 to receive vibration dampening grommets 128 for attachment to the underneath side 40 of the rotor portion of motor 38 by screws 130, generally as disclosed in U.S. Pat. No. 4,511,310. The ring 124, with recesses 126 and grommets 128, are standardized to mate with one of each pair of attaching holes 48 for securely attaching the ring 124 to surface 40. Ring 132 has sets of holes 132 to receive screws 134 for mounting blade irons 136 onto the blade ring 124. Fan blades 58 are connected to the blade irons 136, with or without covers 98, in the same manner as described previously in connection with modular blade attachment 52A illustrated in FIG. 5A.

It will be observed by those skilled in the art that each of the modular blade attachments 52, 52A and 52B imparts a uniquely differentiating style and appearance to the modular fan system of the present invention without significantly increasing the cost to the manufacturer. Hence, the manufacturer can provide a retailer, or a consumer, with a distinctly different style or appearance for the ceiling fan without having to redesign or retool the fan structure or configuration.

Figure 6:
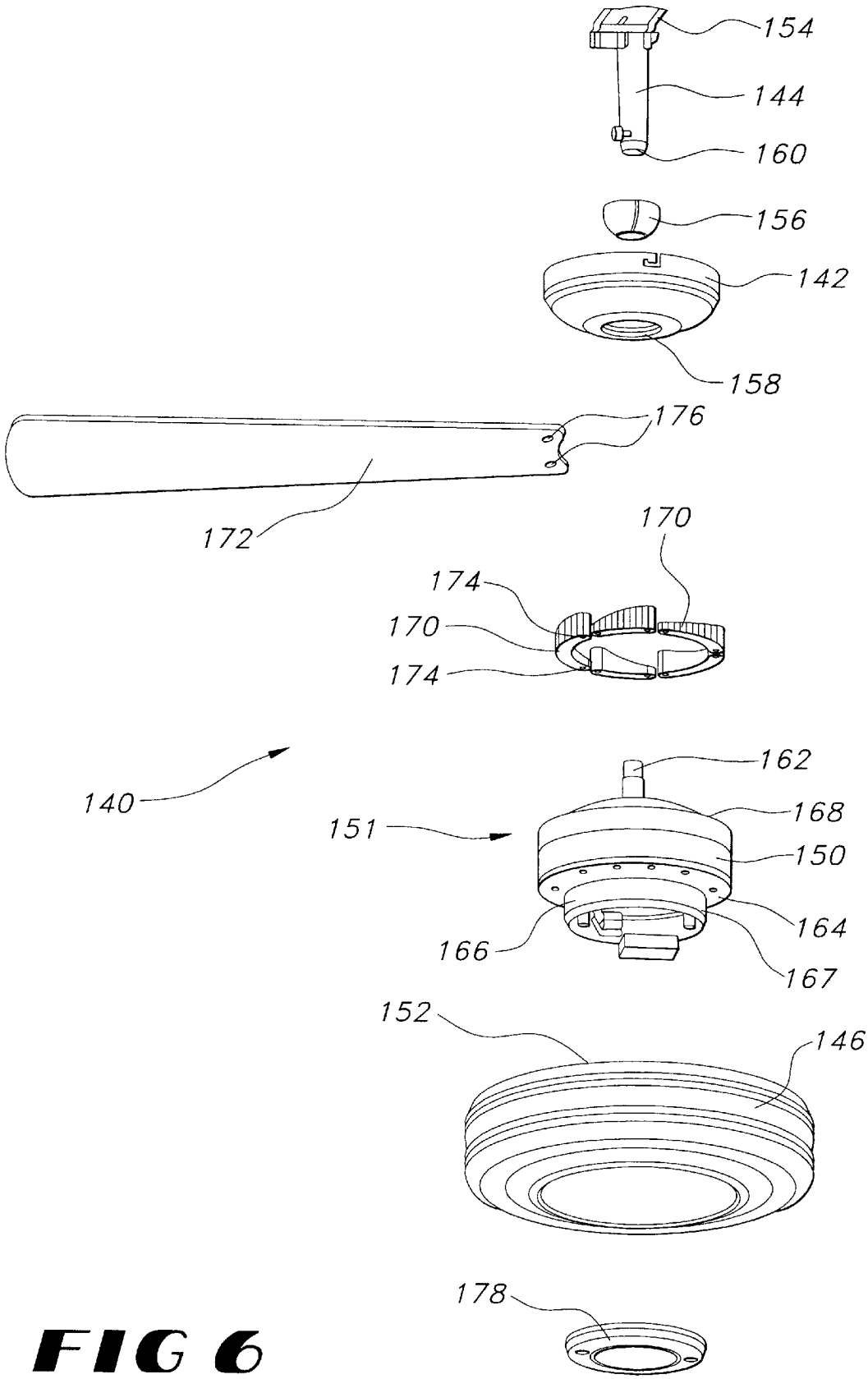
FIG. 6 is a perspective exploded view illustrating the components of a second embodiment of a modular ceiling fan assembly according to the principles of the present invention.

Turning now to FIG. 6 of the drawings, a second preferred arrangement of a modular ceiling fan embodying the teachings of the present invention is generally designated by the numeral 140. The ceiling fan 140 includes a canopy 142, a down rod 144, a modular motor housing 146 and fan blades 148 attached to the upper side of motor 150. A preassembled motor platform 151, including motor 150, switch housing 166 and related electrical switches and wiring is inserted into the modular housing 146 through a central opening 152 in the top wall of the housing 146. The switch housing 166 is secured to the bottom stator shaft adjacent the bottom surface 164 of the motor 150 in a conventional and known manner. As in the first embodiment shown in FIGS. 1–3, the electrical and switch components of the switch housing 166 are conventional, and any known substitution is contemplated within the scope of the present invention. The housing 146 is supported from the motor platform in any known and conventional manner, such as by screws mounting the bottom surface of the motor housing 146 to a flange 167 on the bottom of the switch housing 166. Also secured to the switch housing 166 in a suitable manner is a modular switch housing cover 178, having the same general construction and flexibility as previously described for switch housing cover 64.

In this embodiment, hanger bracket 154 is anchored to an electrical box (not shown) secured in the ceiling. Canopy 146 is secured to the mounting bracket, and supports pivot ball 156 within opening 158. Extending down through the center of pivot ball 156 and opening 158 is the down rod or hanging rod 144. The structure and assembly of the down rod 144 within pivot ball 156 as supported in opening 158 of canopy 146 in this embodiment are fully illustrated and described in U.S. Pat. No. 5,222,864. The lower end 160 of down rod 144 is internally threaded to receive stator shaft 162 of motor 150. The canopy 146, down rod 144 and ball 156 are all standardized in their construction features, as previously described for the first embodiment shown in FIGS. 1–3, so that modular canopy and down rod parts can be substituted in designing a modular ceiling fan assembly having a different configuration, style or appearance in accordance with the present invention.

The upper surface 168 of the motor 150 in this embodiment has the blade mounting holes in pairs, or sets (not shown), substantially identical to the pairs or sets 48 shown for the bottom surface 40 of the motor 38 in the first preferred embodiment. Again, there are preferably five pairs or sets of blade mounting holes in the upper surface 168, and each pair has a constant standardized spacing between them and an equal standardized spacing between adjacent sets. Also, they are all of a predetermined standard diameter.

In this embodiment, standardized blade ramps 170 attach blades 172 to the upper surface 168 of the motor 150. Each standardized blade ramp 170 has the same standard spacing between standardized vertical holes 174 as each set of holes in the top surface 168. Holes 176 in the proximate end of blades 172 have similar standardized diameters and spacing. Thus, screws (not shown) passing downwardly through holes 176 and holes 174 can be threaded into the mounting holes in the motor top surface 168 to anchor and secure the fan blades 172 and blade ramps 170 to the top surface 168 of the motor 150. Only two holes 176 are provided in the proximate end of the fan blades 172 in this embodiment, as opposed to the three holes provided in the first embodiment inasmuch as blade medallions, or covers, are not used in this modular blade attachment because the blades attached to the upper side of the motor are not readily visible by a person observing the fan when standing on the floor.

It should be appreciated that a single motor design, such as motor 38, can be adapted for use in configurations for top mounted blades of the second embodiment and bottom mounted blades of the first embodiment by simply providing standardized sets, or pairs, of holes in both the upper surface and bottom surface of the rotor portion of the motor. Then, depending upon whether the retailer or customer desires a top mounted blade style or a bottom mounted blade style, the manufacturer can provide the requisite modular hardware. For bottom mounted blades, an adaptor, such as adaptor 36, for attachment to the down rod and supporting the modular motor housing can be provided, along with a modular motor housing having a requisite upper section for receiving and supporting on the adaptor, and a bottom section having an opening sufficient to receive the standardized motor platform therethrough. All of the other elements would be standardized and interchangeable in the manner described for the first embodiment. For a top blade mounted style, an adaptor, such as adaptor 36, would not be necessary. The modular motor housing would have an upper section with an opening of sufficient size to permit the housing to be inserted over the motor platform during installation, and a lower section standardized for attachment to the motor platform. Otherwise, all other components of the modular fan assembly would remain the same, and a top blade mounted style could be provided as readily as a bottom blade mounted style with virtually no increase in cost.

Also in accordance with the modular fan structure and assembly of the present invention, the modular blade attachment and modular motor housing can be modified to produce a modular fan assembly having a mid-body blade attachment style (not shown), which give the appearance of having blades which are mounted around the mid-section of the motor. A mid-body blade attachment style ceiling fan assembly can be configured from the modular structure and assembly of the present invention by standardizing the connection structure of the requisite blade irons, fan blades and center band for a mid-body style. All other components of the modular assembly and system are standardized and selected from available parts, as previously described, including separate configurations, styles and appearances for the canopy, down rod, upper and lower sections of the modular motor housing, and switch housing cover. As such, uniquely distinctive mid-body ceiling fans can be provided by the manufacturer at virtually no significant increase in cost.

While not specifically described in connection with the foregoing embodiments, it will be appreciated that each configuration can be provided with a light kit to further differentiate the final modular fan assembly from other ceiling fan designs. The light kit component would be provided with standardized connecting structure for incorporation into the selected modular assembly in any known and conventional manner.

Figure 12:
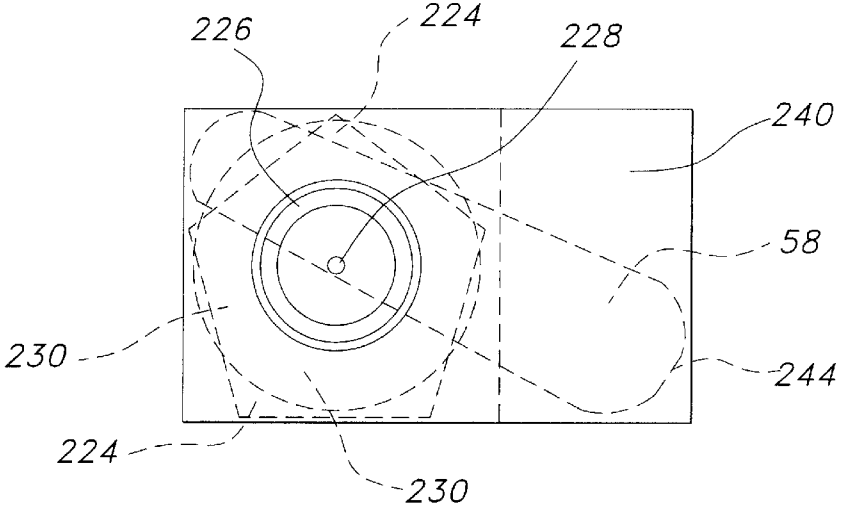
FIG. 12 is a top view of the packing cushion having the principal components illustrated in FIG. 10 positioned therein.
Figure 13:
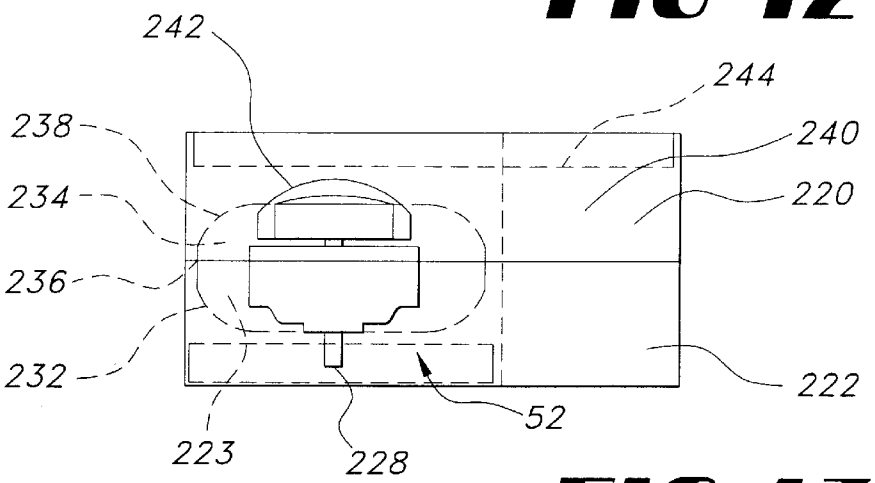
FIG. 13 is a side view of the packing cushion and components illustrated in FIG. 11.
Figure 11:
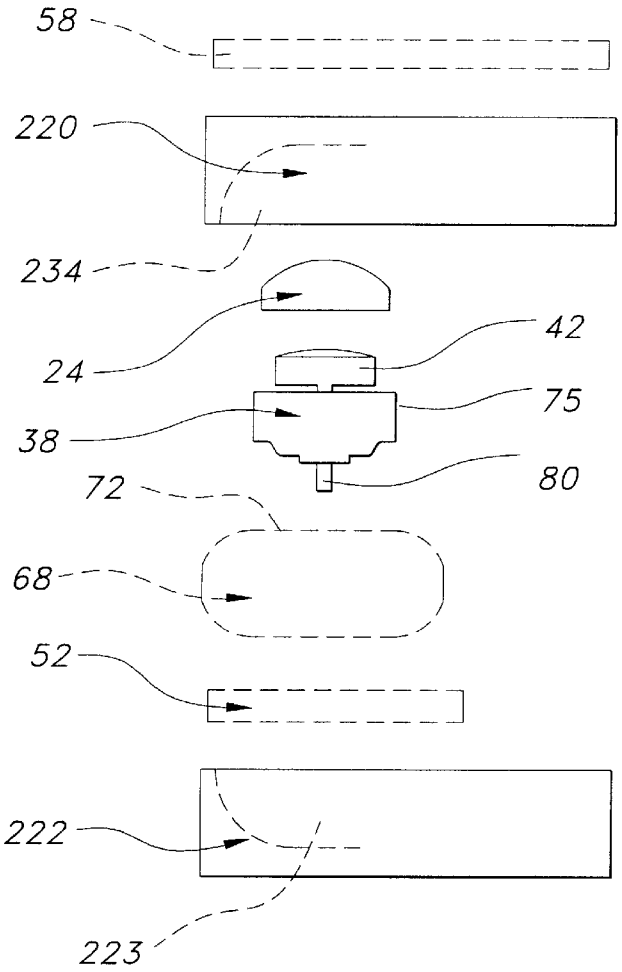
FIG. 11 is an exploded side view of the principal components of a modular ceiling fan assembly to be placed in a packing cushion in accordance with the present invention.

Due to the standardization of the components for the modular assembly in accordance with the present invention, the internal packaging, as well as the packing carton, can also be standardized. More specifically, each cavity in the cushioning foam mold is designed to contain a certain part of the modular fan assembly. As a result of the minimal variation in the size of each component, one cavity can be engineered for all deviations of such component. An example of standardized cushioning foam mold for packaging a modular fan assembly as disclosed in FIGS. 1–3, is illustrated in FIGS. 11–13.

As shown, the cushioning foam mold includes a top foam section 220 and a bottom foam section 222. The bottom foam section 222 has a cutout 223 which is configured on its bottom surface to receive and support integral blade ring and paddle assembly 52. Hence, the bottom surface of the cutout has circumferential tapered sections 224 to support paddles 90 and a central raised section 226 which is surrounded by ring 85 of assembly 52. The raised section 226 has a centrally located cylindrical hole 228 to receive and support the lower end 80 of the stator shaft of the motor 38.

The bottom surface of the cutout 223 in bottom foam section 222 is also configured such that there are raised portions 230 which extend radially inwardly around each of the paddles 90 of the blade ring and paddle assembly 52 when positioned in the bottom of lower foam section 222. The sections 230 slope radially upwardly, as at 232, in order to generally conform to the surface and support the modular motor housing 68. As shown, the modular motor housing 68 is fully assembled before placing into the packing foam material. Also, in this embodiment, the modular motor housing has opening 72 in the bottom of the lower section 104 to receive the motor platform 75. Hence, the modular motor housing is upside down in the packaging cushion, or foam, so that the opening 72 is facing upwardly to receive the motor 38 or platform 75 when packing the fan assembly. Before placing the modular motor housing into section 222 of the foam mold, a suitable insulation sheet or the like is preferably positioned over the blade ring and paddle assembly 52 to prevent contact with the housing 68 during shipment.

Once the modular motor housing has been positioned on elements 230 of the bottom surface of the bottom foam section 222, in an upside down position such that the upper section 102 rests on raised portions 232, the preferably preassembled motor platform 75 is inserted so that stator shaft 80 is supported in hole 228. Before packing, the motor 38, with its upper and lower shafts, has been previously assembled into the motor platform 75 with switch housing 42 and related electrical components and wiring. The cutout 234 of the top foam section 222 is configured to register with that portion of the lower cutout 223 which terminates at the top of raised portions 232, as at 236, and to receive and hold in place the lower portion of the modular housing assembly 68, as at 238.

While canopy 24 can be packed separately from the other modular components illustrated in FIG. 1, in another cutout between the upper and lower foam sections 220 and 222, in the portion of the packaging cushion designated by the numeral 240, the canopy 24 can also be packed in accordance with the present invention over the switch housing 42 of the motor platform 75, as provided, and a light kit, if included in the fan assembly. It will be noted that the cutouts for these additional components, in the cushion area designated 240, are completely independent of the primary cutouts 223 and 234.

It will also be observed that the configuration for the packing cushion or foam mold, illustrated in FIGS. 11–13, is designed to support the modular motor housing 68 and motor platform 75 even if blade ring and paddle assembly 52 is not included in the packaged modular ceiling fan assembly. In such instance, the blade ring and paddle assembly 52 can be left out of the packaging, and the appropriate blade irons, or blade ramps, provided in the auxiliary cutout in the cushion or foam area designated 240. Thus, as shown, the packaging cushion can include standardized size cutouts for receipt of the components within the size limitation ranges provided, regardless of alternative components incorporated into the modular ceiling fan assembly of the present invention.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed is:

1. A modular ceiling fan assembly which comprises a motor, a motor housing surrounding said motor, and a set of rotating fan blades, said motor housing having as inter changeable standardized height and an interchangeable standardized connecting structure for assembly of said housing into said fan assembly and including a separate upper section and a separate lower section, each selected from a plurality of upper and lower sections having differentiatingly distinctive heights, configurations and appearances and when combined form said motor housing with said standardized height and connecting structure.

2. A modular ceiling fan assembly which comprises a motor, a motor housing surrounding said motor, and a set of rotating fan blades, said motor housing having an inter changeable standardized height and an inter changeable standardized connecting structure for assembly of said housing into said fan and includes a separate upper section and a separate lower section, each selected from a plurality of upper and lower sections having differentially distinctive configurations and appearances, and a center band selected from a plurality of center bands having a standardized size which, when combined with said selected upper and lower sections forms said motor housing with said standardized height.

3. A modular motor housing for a ceiling fan assembly which comprises a standardized height and has a horizontal upper section and a horizontal lower section, each of which is selected from a plurality of interchangeable alternative sections having differentiatingly distinctive heights, configurations and appearances which, when combined, form said motor housing into said standardized height to accommodate a single common motor platform.

4. A modular motor housing for a ceiling fan assembly which comprises a standardized height and has a horizontal upper section and a horizontal lower section, each of which is selected from a plurality of interchangeable alternative sections having differentially distinctive configurations and appearances and a center band which, when combined with said selected upper and lower sections, forms said motor housing into said standardized height to accommodate a single common motor platform.

5. An interchangeable modular ceiling fan assembly which comprises a canopy, a motor, a motor housing surrounding said motor, a switch housing, a blade attachment structure and a set of fan blades, said motor housing having a standardized height and a standardized connecting structure to accommodate a single common motor platform, and having at least two components selected from a plurality of interchangeable parts for each component, said parts having one or more standardized sizes and differing appearances to provide a variety of differently appearing interchangeable motor housings.

6. An interchangeable modular ceiling fan assembly as defined in claim 5, wherein said at least two components include a horizontal upper section and a horizontal lower section each having a standardized height.

7. An interchangeable modular ceiling fan assembly as defined in claim 6, wherein said motor housing also includes a center band selected from a plurality of center bands having a standardized height.

8. An interchangeable modular ceiling fan assembly as defined in claim 6, wherein said single common motor platform includes a motor and switch housing with appropriate electrical switches and electrical wiring and standardized connection structure.

9. An interchangeable modular ceiling fan assembly as defined in claim 8, wherein said canopy, switch housing, blade attachment structure and fan blades are selected from a plurality of canopies, switch housings, blade attachment structures and fan blade sets, each of which has standardized connecting structure for connection to said standardized connection structure of said motor platform.

10. An interchangeable modular ceiling fan assembly as defined in claim 9, wherein said motor has substantially horizontal upper and lower rotor surfaces and said standardized connection structure is a plurality of threaded holes in said lower rotor surface, standardized in size and spacing, for receiving screws to attach said blade attachment structure and a selected fan blade set to said lower rotor surface, and said blade attachment structure is selected from an integral blade ring and paddle assembly, blade ramps, and blade ring and blade irons, each of which has mounting holes of a standardized size and spacing which mate with a portion of said standardized holes in said lower rotor surface.

11. An interchangeable modular ceiling fan assembly as defined in claim 9, wherein said motor has substantially horizontal upper and lower rotor surfaces and said standardized connection structure is a plurality of threaded holes in said upper rotor surface and said lower rotor surface for receiving screws to attach said blade attachment structure and a selected fan blade set to either of said rotor surfaces, said threaded holes in said upper and lower rotor surfaces having the same standardized size and spacing, and said blade attachment structure, said motor housing and said fan blade set being selected to configure said fan assembly as a top blade mounted fan, a bottom blade mounted fan, or a mid-body blade mounted fan.

12. An interchangeable modular ceiling fan assembly as defined in claim 6, wherein said standardized height for said motor housing is approximately 4.75 inches and each of said upper and lower sections is selected from a series of upper and lower sections having short, medium and tall standardized heights and when combined form a motor housing having a height of approximately 4.75 inches.

13. An interchangeable modular ceiling fan assembly as defined in claim 6, wherein said motor housing also includes a center band selected from a plurality of center bands having a standardized height and combined with said upper section and said lower section to form a motor housing having a height of approximately 4.75 inches.

* * * * *